United States Patent [19]

Bissett

[11] 4,154,359

[45] May 15, 1979

[54] SHOE TYPE SEAL FOR FLOATING TANK ROOF, OR THE LIKE

[76] Inventor: Bill E. Bissett, 6511 Bacarro St., Long Beach, Calif. 90815

[21] Appl. No.: 851,364

[22] Filed: Nov. 14, 1977

[51] Int. Cl.[2] ..... B65D 87/207

[52] U.S. Cl. ..... 220/222; 220/224

[58] Field of Search ..... 220/222, 224, 216

[56] References Cited

U.S. PATENT DOCUMENTS

| | | | |
|---|---|---|---|
| 2,740,549 | 4/1956 | Graham et al. | 220/222 |
| 2,788,913 | 4/1957 | Allen | 220/222 |
| 3,185,335 | 5/1965 | Lecler | 220/222 |

*Primary Examiner*—William Price
*Assistant Examiner*—Steven M. Pollard
*Attorney, Agent, or Firm*—Harris, Kern, Wallen & Tinsley

[57] ABSTRACT

A variable-volume storage tank, or the like, of the type having a floating roof, including an upright cylindrical shell, a circular roof within the cylindrical shell and adapted to float on the surface of a liquid within the shell, a circular metallic-shoe seal ring encircling and spaced outwardly from the roof and slidably engaging the shell, circumferentially spaced, outwardly concave, bowed leaf spring hangers extending between the roof and the seal ring, means connecting each of the hangers to the roof intermediate the ends of the hanger, means permitting horizontally circumferential movement of the ends of each of the hangers relative to the seal ring for connecting the ends of the hanger to the seal ring, and a flexible annular seal extending between the roof and the seal ring and having its inner periphery secured to the roof and its outer periphery secured to the seal ring.

5 Claims, 3 Drawing Figures

SHOE TYPE SEAL FOR FLOATING TANK ROOF, OR THE LIKE

CROSS-REFERENCE TO RELATED APPLICATION

The present application discloses subject matter disclosed and claimed in my co-pending patent application Ser. No. 794,798, filed May 9, 1977.

BACKGROUND OF INVENTION

The present invention relates in general to a variable-volume storage tank, or the like, of the type having an upright cylindrical shell and a circular roof within the cylindrical shell and adapted to float on the surface of a liquid within the shell. A circular metallic-shoe seal ring encircles and is spaced outwardly from the roof and slidably engages the shell. A hanger means interconnecting the roof and the seal ring supports the seal ring and serves to center the roof and to urge the seal ring radially outwardly against the shell. A flexible annular seal extends between the roof and the seal ring above the hanger means and has its inner periphery secured to the roof and its outer periphery secured to the seal ring. As disclosed and claimed in my aforementioned co-pending patent application, a secondary seal is located above and supplements the action of the structure just described.

Floating-roof storage tanks of the foregoing general nature are widely used in the oil industry to store variable quantities of petroleum and/or petroleum products, such as gasoline, while, at the same time, maintaining relatively vapor-tight seals between the floating roofs and the upright cylindrical shells of the tanks.

SUMMARY AND OBJECTS OF INVENTION

With the foregoing background in mind, the present invention may be summarized as comprising, and a primary object is to provide a hanger means which includes: bowed leaf spring hangers positioned around the roof in circumferentially spaced relation and extending outwardly, in outwardly concave positions, from the floating roof to the seal ring; means for securing each of the hangers to the roof intermediate the ends of the hanger; and means permitting horizontally circumferential movement of the ends of each of the hangers relative to the seal ring for connecting the ends of the hanger to the seal ring. A related object is to provide a hanger means wherein the ends of each hanger carry vertical pins and wherein the seal ring carries mounting clips having horizontal, circumferentially extending slots receiving the ends of the pins.

Another object is to provide a storage tank wherein the seal ring is provided with a circumferentially extensible and contractible expansion joint.

Among the advantages of the hanger means of the invention is that it maintains uniform tension in the seal ring circumferentially thereof. Another advantage is that each leaf spring hanger operates as an anti-rotation device tending to resist rotation of the floating roof. Even if the roof does rotate, the hanger means of the invention cannot bind and tend to pull the seal ring away from the cylindrical shell.

Another feature of the hanger means of the invention is that it is readily adaptable to different spacings of the roof and the shell. Still another feature is that the hanger means provides an integral supporting and tensioning mechanism for the seal ring.

Yet another feature is that the hanger means provides a self-centering mechanism for the floating roof since each increment of roof travel from center provides an increasing force in the opposite direction resisting and limiting such travel.

The foregoing objects, advantages, features and results of the present invention, together with various other objects, advantages, features and results thereof which will be evident to those skilled in the floating-roof storage tank art in the light of this disclosure, may be achieved with the exemplary embodiment of the invention illustrated in the accompanying drawing and described in detail hereinafter.

DESCRIPTION OF EXEMPLARY EMBODIMENT OF INVENTION

Figure 1:
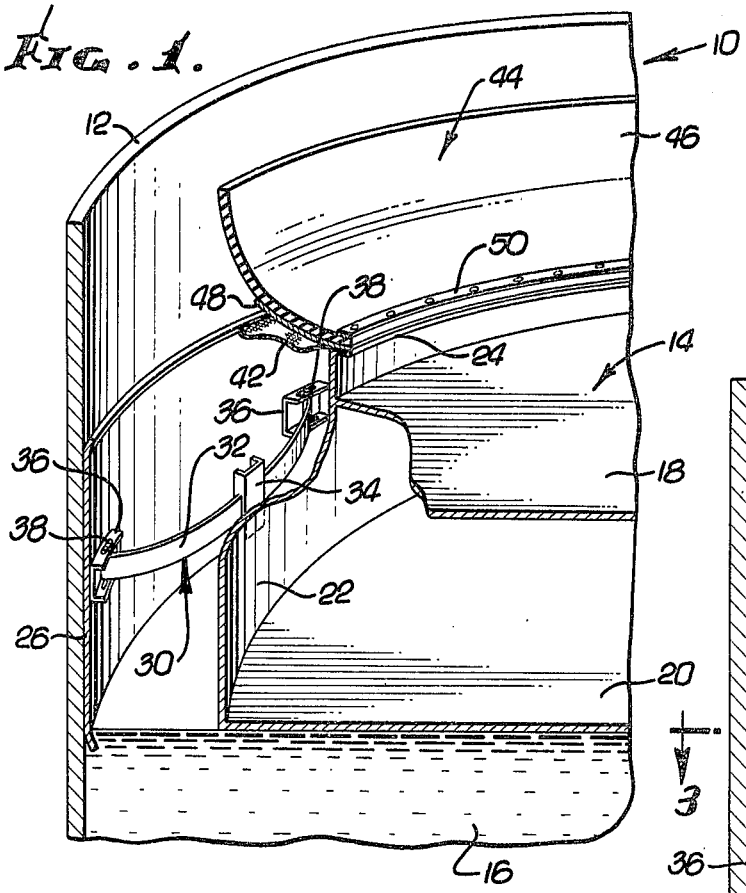
FIG. 1 is a fragmentary perspective view of a floating-roof storage tank which embodies the invention.

In the drawing, the numeral 10 designates generally a fragment of a variable-volume floating-roof storage tank which embodies the invention. The storage tank 10 includes an upright cylindrical shell 12 and a circular roof 14 within and spaced radially inwardly from the cylindrical shell and adapted to float on the surface of a liquid 16 within the shell. The floating roof is a hollow structure having top and bottom walls 18 and 20 interconnected by a vertical circumferential wall 22 which extends upwardly above the top wall 18 and terminates in an inturned annular flange 24. The floating roof 14 is normally made of a metal such as steel.

Figure 3:
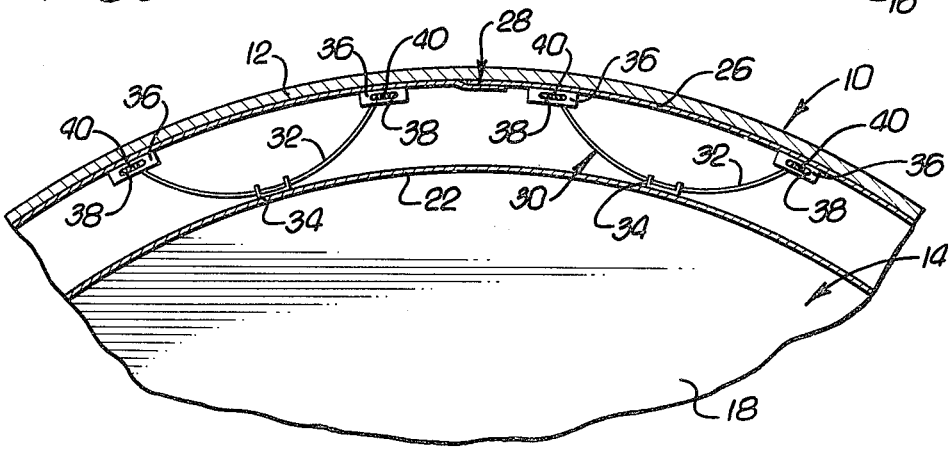
FIG. 3 is a sectional view on a reduced scale taken along the arrowed line 3—3 of FIG. 2.

A circular metallic, e.g., steel, shoe-type seal ring 26 encircles and is spaced outwardly from the floating roof 14 and slidably engages the inner surface of the cylindrical shell 12. The seal ring 26 is provided with a circumferentially extensible and contractible expansion joint 28, FIG. 3, formed by overlapping one end of the seal ring with the other end thereof. The overlapped ends are preferably interconnected in such a manner, not specifically shown, that they can move circumferentially relative to each other without relative vertical movement.

Figure 2:
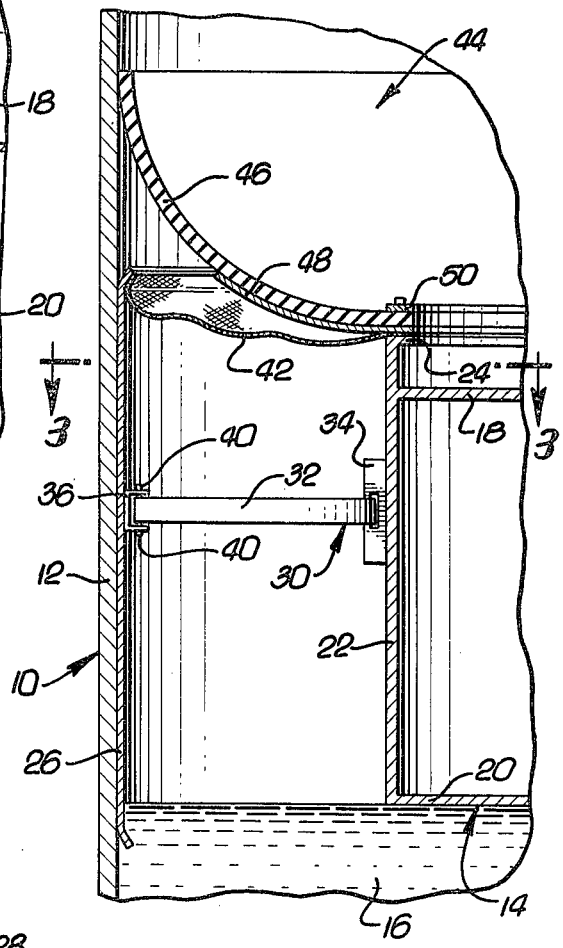
FIG. 2 is an enlarged vertical sectional view in effect taken in the plane of the left side of FIG. 1.

The seal ring 26 is connected to and supported by the floating roof 14 through a hanger means 30 which comprises circumferentially spaced, outwardly concave, bowed leaf spring hangers 32 extending between the floating roof and the seal ring. Each of the hangers 32 is connected to the floating roof 14 intermediate the ends of such hanger. Preferably, the connecting means for securing each hanger 32 to the floating roof 14 comprises a vertical channel 34 welded, or otherwise secured, to the circumferential wall 22 of the floating roof 14. The legs of each channel 34 are provided with openings through which the corresponding leaf spring hanger 32 extends loosely, as will be clear from FIG. 2 in particular.

The outer ends of each of the leaf spring hangers 32 are connected to the seal ring 26 by means permitting horizontally circumferential movement of the ends of such hanger relative to the seal ring. More particularly, this connecting means comprises two circumferentially spaced, circumferentially horizontally extending channels 36 the legs of which are provided with horizontal, circumferentially extending slots 38. The ends of each leaf spring hanger 32 are provided with vertical pins the ends of which extend into the corresponding slots 38.

With the foregoing construction, each leaf spring hanger 32 can yield in the event that the floating roof 14 tends to move from a centered position relative to the cylindrical shell 12. At the same time, such a yielding hanger resists any tendency of the floating roof to move from a centered position, and resists any such movement tendency with an increasing force, thereby limiting movement. As previously pointed out, the hanger means 30 thus provides a self-centering mechanism for the floating roof 14, which is an important feature of the invention. The manner in which the hanger means 30 achieves the various advantages hereinbefore discussed will be apparent so that a further explanation is not necessary.

A flexible annular seal 42 extends between the floating roof 14 and the seal ring 26 and has its inner periphery suitably secured to the floating roof and its outer periphery suitably secured to the seal ring. The flexible annular seal 42 may be made of a vapor-proof fabric, and is preferably wide enough to provide slack permitting some movement of the floating roof 14 from a centered position without damage to this seal. It will be noted that the seal 42 is located above the hanger means 30 and extends between and is suitably secured to the flange 24 and the upper edge of the seal ring 26.

The structure shown also includes a secondary seal 44 similar to that disclosed and claimed in my aforementioned co-pending patent application. Briefly, the secondary seal 44 comprises an upwardly concave lip seal 46 the outer periphery of which is engageable with the inner surface of the cylindrical shell 22, and the inner periphery of which is connected to the floating roof 14. The lip seal 46 is maintained in its upwardly concave position by a supporting means 48, as more fully disclosed in my aforementioned copending application. The inner edges of the lip seal 46 and the supporting means 48 may be clamped to the annular flange 24 on the floating roof 14, with the inner periphery of the annular seal 42 clamped between the flange 24 and the supporting means 48 to secure it to the floating roof. This clamping action may be achieved by a clamp ring 50 suitably bolted to the annular flange 24.

Although an exemplary embodiment of the invention has been disclosed for illustrative purposes, it will be understood that various changes, modifications and substitutions may be incorporated in such embodiment without departing from the invention as hereinafter claimed.

I claim as my invention:

1. In a variable-volume storage tank, or the like, the combination of:

(a) an upright cylindrical shell;

(b) a circular roof within said cylindrical shell and adapted to float on the surface of a liquid within said shell;

(c) a circular metallic-shoe seal ring encircling and spaced outwardly from said roof and slidably engaging said shell;

(d) circumferentially spaced, outwardly concave, bowed leaf spring hangers extending between said roof and said seal ring;

(e) means permitting horizontally circumferential movement of each of said hangers relative to said roof for loosely connecting each of said hangers to said roof intermediate the ends of said hanger;

(f) means permitting horizontally circumferential movement of the ends of each of said hangers relative to said seal ring for connecting the ends of said hanger to said seal ring; and (g) a flexible annular seal extending between said roof and said seal ring and having its inner periphery secured to said roof and its outer periphery secured to said seal ring.

2. A storage tank as defined in claim 1 wherein the ends of each of said hangers carry vertical pins and wherein said seal ring carries mounting clips having horizontal, circumferentially extending slots receiving the ends of said pins.

3. A storage tank according to claim 2 wherein said flexible annular seal is disposed above said hangers.

4. A storage tank as set forth in claim 1 wherein said seal ring is provided with a circumferentially extensible and contractible expansion joint.

5. In combination with a variable-volume storage tank which includes an upright cylindrical shell, a circular roof within said cylindrical shell and adapted to float on the surface of a liquid within said shell, and a metallic-shoe seal ring encircling said roof and slidably engaging said shell, hanger means for supporting said seal ring, including:

(a) bowed leaf spring hangers adapted to be positioned around said roof in circumferentially spaced relation and to extend outwardly, in outwardly concave positions, from said roof to said seal ring;

(b) means permitting horizontally circumferential movement of each of said hangers relative to said roof for loosely connecting each of said hangers to said roof intermediate the ends of said hanger; and (c) means permitting horizontally circumferential movement of the ends of each of said hangers relative to said seal ring for connecting the ends of said hanger to said seal ring.

* * * * *